United States Patent [19]

Hori et al.

[11] 4,168,830

[45] Sep. 25, 1979

[54] AIR JET PAPER PICK-OFF FOR LIQUID DEVELOPER ELECTROSTATIC COPIER

[75] Inventors: Tatsu Hori, Los Altos; Kenneth W. Gardiner, Menlo Park; Norman F. Mangal, Palo Alto, all of Calif.

[73] Assignee: Savin Corporation, Valhalla, N.Y.

[21] Appl. No.: 847,258

[22] Filed: Oct. 31, 1977

Related U.S. Application Data

[63] Continuation of Ser. No. 565,358, Apr. 7, 1975.

[51] Int. Cl.[2] ..... B65H 43/00

[52] U.S. Cl. ..... 271/176; 118/245; 271/186; 271/195; 271/DIG. 2; 271/DIG. 9; 432/60

[58] Field of Search ..... 271/DIG. 2, 80, 174, 271/176, 195, DIG. 9, 186, 225; 118/60, 245; 432/60

[56] References Cited

U.S. PATENT DOCUMENTS

| | | | |
|---|---|---|---|
| 1,595,478 | 8/1926 | Minton | 271/DIG. 2 |
| 3,506,259 | 4/1970 | Caldwell | 271/80 X |
| 3,687,539 | 8/1972 | Furuichi | 355/8 |
| 3,695,756 | 10/1972 | Smith | 271/DIG. 2 |
| 3,867,026 | 2/1975 | Ogawa | 355/8 |
| 3,885,785 | 5/1975 | Burkett | 271/174 |
| 3,907,280 | 9/1975 | Bendall | 271/DIG. 2 |
| 3,920,331 | 11/1975 | Kurita | 355/16 |

*Primary Examiner*—Richard A. Schacher
*Attorney, Agent, or Firm*—Shenier & O'Connor

[57] ABSTRACT

Apparatus for separating a sheet of paper to which a developed toner image has been transferred from a moving photoconductive surface by directing a high velocity flow of air against an edge of a leading portion of the sheet on the surface to separate said portion, and exerting pneumatic pressure on the separated sheet portion to separate the remainder of the paper from the photoconductive surface. The high velocity air stream is pulsed to coincide with the arrival of the paper edge at a predetermined point in the separating apparatus.

34 Claims, 15 Drawing Figures

Fig 3
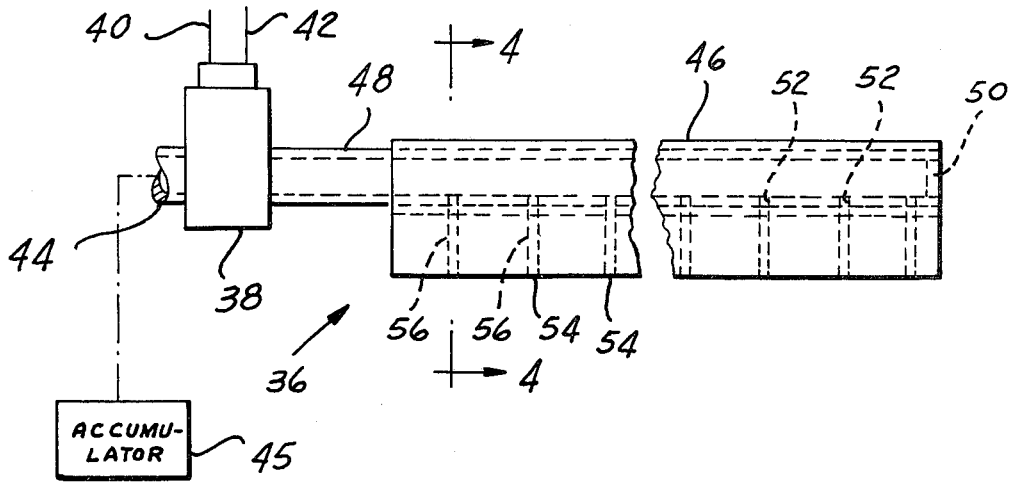
Fig 4
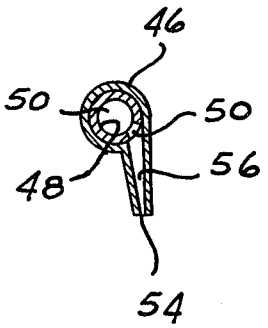
Fig 5
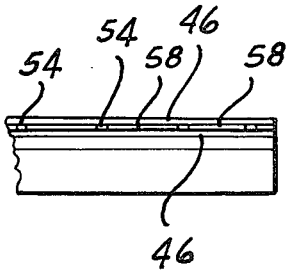
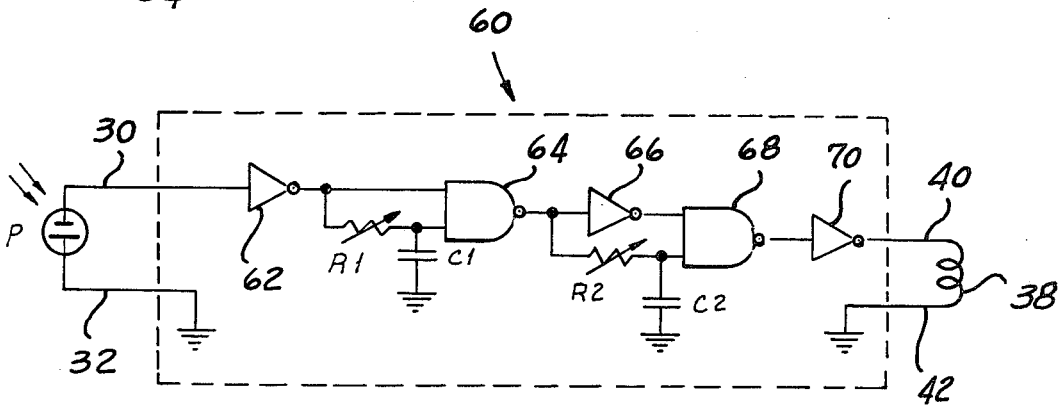
Fig 6

FIG 7
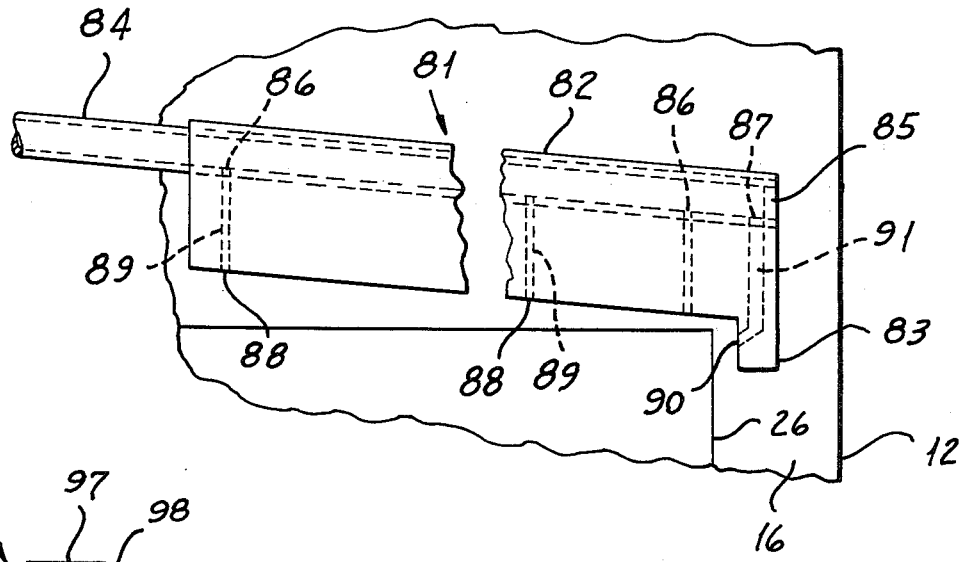
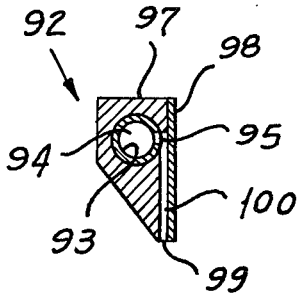
FIG 9
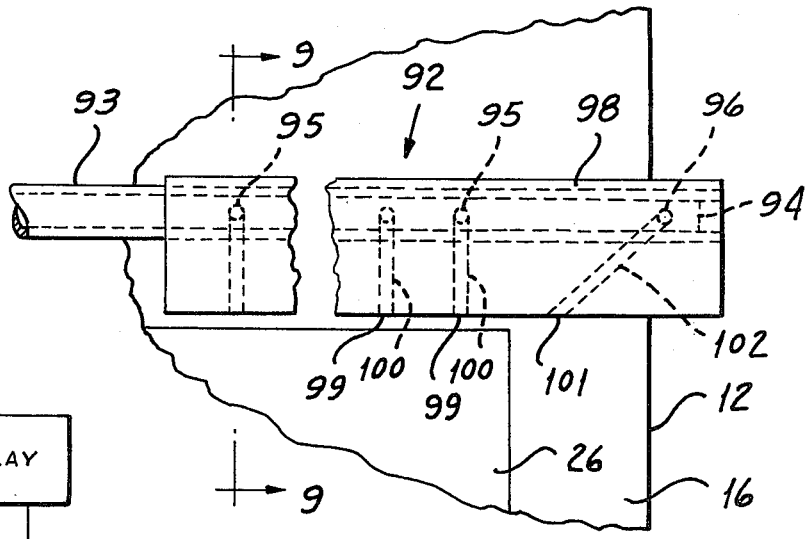
FIG 8
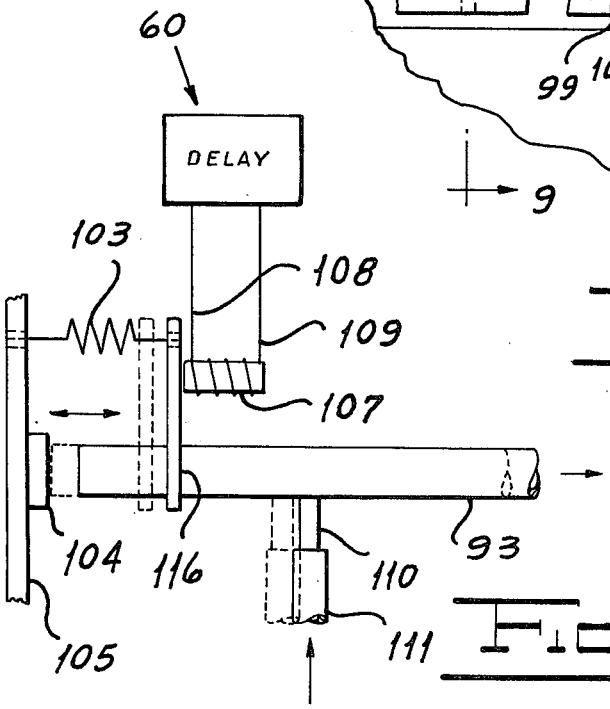
FIG 10

Fig 14
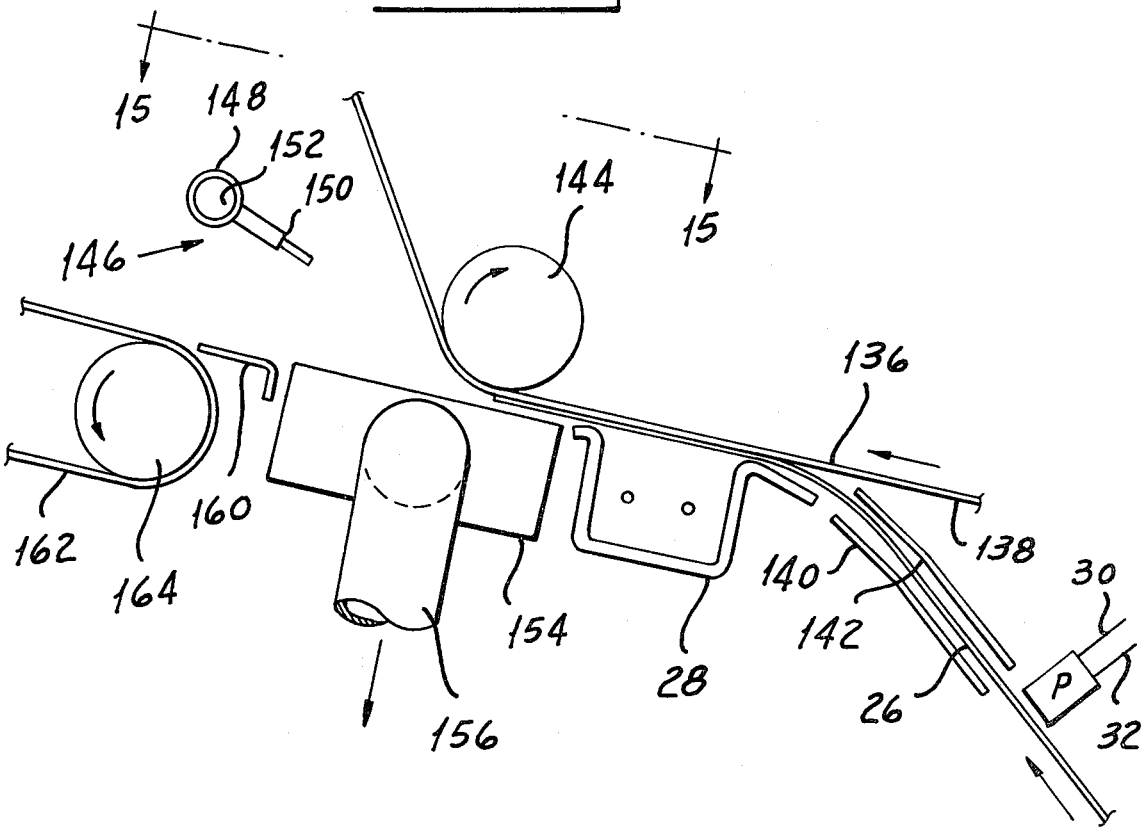
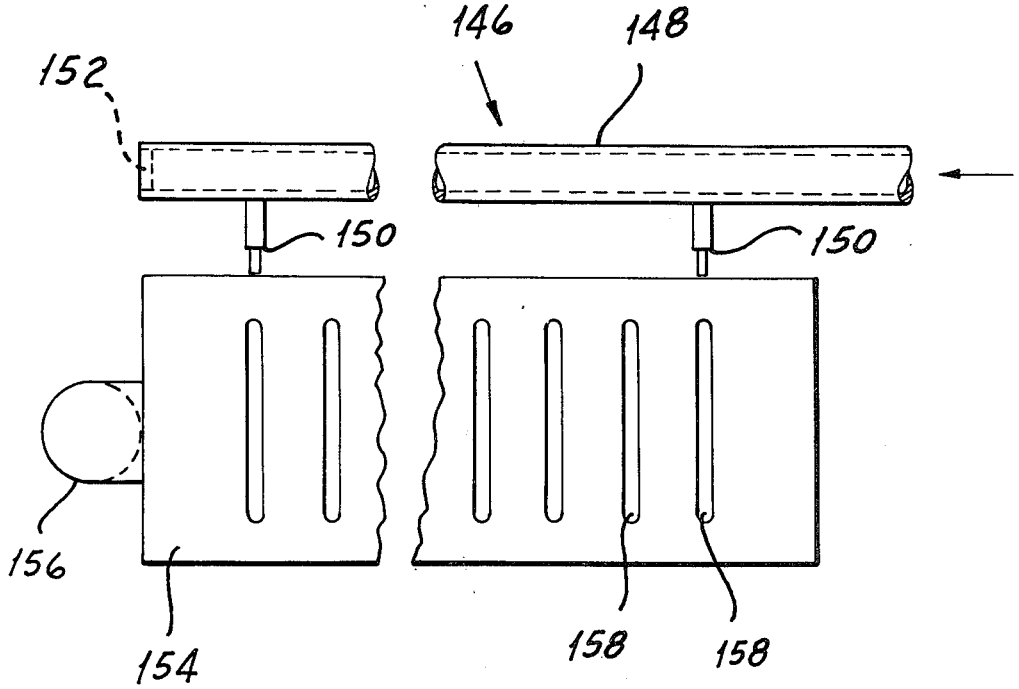
Fig 15

AIR JET PAPER PICK-OFF FOR LIQUID DEVELOPER ELECTROSTATIC COPIER

This is a continuation of application Ser. No. 565,358, filed Apr. 7, 1975.

BACKGROUND OF THE INVENTION

This invention relates to an improved pick-off means for use in a plain paper type electrostatic copier.

Electrostatic copiers of the plain paper type, in which developed toner particle images are transferred from a photoconductive surface, such as that of a rotating drum or endless belt, to an untreated surface, such as that of ordinary paper, are known in the art. In these copiers, it is necessary to provide means for separating the photoconductive surface from the paper surface once the transfer step is completed. Where a corona charger or similar device is used to give the paper an electrostatic charge to assist the transfer process, the pick-off must overcome the tendency of the paper to cling to the photoconductive surface under the influence of the charge from the transfer device. Clinging also occurs where liquids are used to develop the latent electrostatic image as is common in the art. Pick-off means which mechanically grip the paper edges during the transfer step to provide positive separating action suffer the disadvantage of reducing the effective image receiving area of the paper. Other pick-off means which operate by introducing a sharp curvature in the path of a photoconductive belt for example do not lend themselves to use with drum-type machines.

SUMMARY OF THE INVENTION

One object of our invention is to provide a pick-off means for use in a plain type electrostatic copier.

A second object of our invention is to provide a pick-off means for use in a plain paper type electrostatic copier which effectively separates paper which has been electrostatically charged in the course of image transfer from a photoconductive surface.

A third object of our invention is to provide a pick-off means for use in a plain paper type electrostatic copier which does not reduce the effective image receiving area of the paper.

A fourth object of our invention is to provide a pick-off means for use in a plain paper type electrostatic copier which is especially adapted for use on a drum type machine.

Other and further objects of our invention will appear from the following description.

In general our invention contemplates a pneumatic pick-off means which separates a portion of the sheet of paper from the photoconductive surface by using a high velocity air jet means to direct a high velocity flow or jet of air against an edge of a leading sheet portion to initiate movement of the sheet away from the photoconductive surface. Once a portion of the sheet is separated in this manner, the remainder of the sheet of paper is separated from the photoconductive surface by a device which exerts pneumatic pressure against the under surface of the separated sheet portion to strip the remainder of the sheet away from the photoconductive surface as the surface moves past the device. The separating operation is thus a two-step operation comprising a first step of using a high velocity means to "crack" apart a portion of the paper and a second step of using a lower velocity stripping pressure means to peel away the separated portion.

Our high velocity means may consist, variously, either of one or more nozzles or of a manifold having a plurality of orifices.

Air jets may be directed either against the leading edge or the side edge of the paper, depending on the peeling method desired.

The stripping means may consist of either an additional nozzle or manifold for directing a lower velocity stream of air against the lower surface of the separated portion or, as in one embodiment, a perforated vacuum chamber arranged adjacent to the outer surface of the separated portion. To conserve the air supply, we pulse the high velocity means and, in one embodiment, the pressure means to coincide with the arrival of the paper edge at the proper point in the pick-off means.

BRIEF DESCRIPTION OF THE DRAWINGS

In the accompanying drawings which form part of the instant specification and which are to be read in conjunction therewith and in which like reference numerals are used to indicate like parts in the various views:

FIG. 3 is a fragmentary top plan of the high velocity air jet manifold used in the machine shown in FIGS. 1 and 2.

FIG. 4 is a section of the high velocity air jet manifold shown in FIG. 3 taken along line 4—4 of FIG. 3.

FIG. 5 is a fragmentary front elevation of the high velocity air jet manifold shown in FIG. 3.

FIG. 6 is a schematic diagram of the delay circuit used to actuate the high velocity air jet manifold shown in FIG. 3.

FIG. 7 is a fragmentary top plan of an alternative embodiment of our pneumatic pick-off means in which the high velocity air jet manifold includes an edge orifice.

FIG. 8 is a fragmentary top plan of another alternative embodiment of our pneumatic pick-off means in which the high velocity air jet manifold is formed from a single piece of material.

FIG. 9 is a section of the high velocity air jet manifold shown in FIG. 8 taken along line 9—9 of FIG. 8.

FIG. 10 is a fragmentary top plan of the valve control for the air jet manifold shown in FIG. 8.

FIG. 14 is a fragmentary side elevation of an alternative embodiment of our pneumatic pick-off means for use in a belt type machine.

FIG. 15 is a fragmentary plan of the embodiment shown in FIG. 13 taken along line 15—15 of FIG. 14.

DESCRIPTION OF THE PREFERRED EMBODIMENTS

Figure 1:
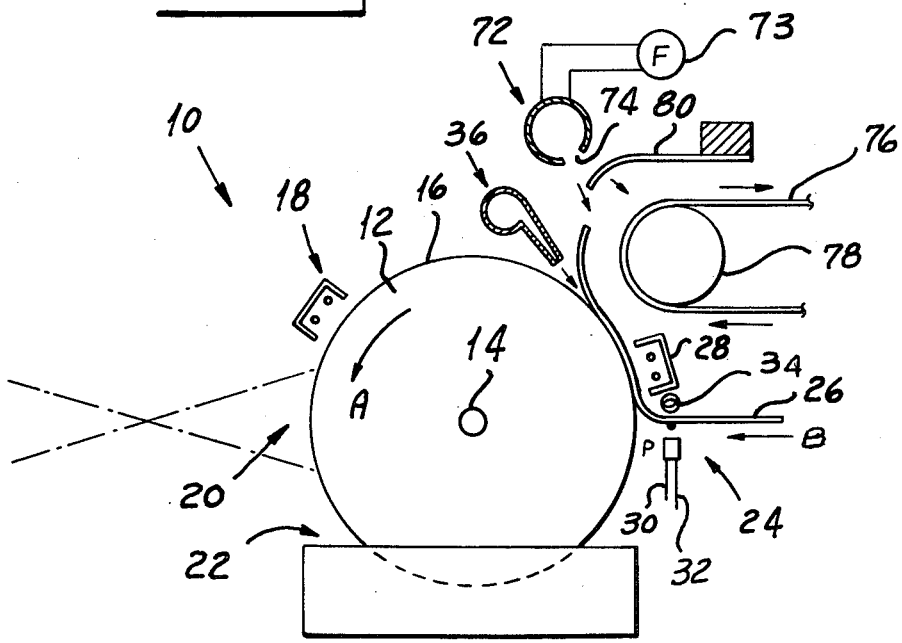
FIG. 1 is a side elevation of a machine incorporating one embodiment of our pneumatic pick-off means with some parts shown in section.

Referring to FIGS. 1 through 6, one embodiment of our pneumatic pick-off is included in an electrostatic copying machine indicated generally by the reference character 10 having a cylindrical drum 12 which is mounted on a horizontal shaft 14 for rotation in the direction shown by the arrow A. The drum 12 is provided with a photoconductive surface 16 on which an electrostatic image is formed. Machine 10 includes a plurality processing stations spaced around drum 12, these stations include a charging station 18 for providing the photoconductive surface 16 with a uniform electrostatic charge, an exposure station 20 for exposing the surface 16 to a light image of the original to discharge the surface 16 in the areas exposed to light to form a latent electrostatic latent image, a developing station 22 for depositing toner particles in the areas retaining a charge to form a visible image, and a transfer station 24 for transferring the developed image from the photoconductive surface 16 to a sheet of paper 26.

At the transfer station 24, the sheet of paper 26 is moved towards the photoconductive surface along the path indicated by the arrow B and engages the surface 16 over an arcuate portion for transfer of a developed image. A corona charger 28 assists the transfer by providing sheet 26 with a charge opposite in polarity to that of the toner particles on the photoconductive surface 16. A photocell P, coupled to lines 30 and 32 respectively, and a light source, such as a bulb 34, are placed on opposite sides of the path B to detect the passage therebetween of the leading edge of the sheet of paper 26 for a purpose to be described.

A high velocity air jet manifold 36 adapted to direct a plurality of high velocity air jets against the leading edge of the paper 26 extends across the drum surface 16 in spaced relationship thereto at a location following that of the charger 28. The manifold 36 is coupled by means of a solenoid valve 38 controlled through lines 40 and 42 to a pipe 44 connected to a source of high pressure air such as an accumulator tank 45.

We form the manifold 36 by wrapping a metal plate 46 around a metal tube 48 having a cap 50 at one end and having a plurality of perforations 52 such that the ends of the metal plate 46 are separated by a gap of from 0.005 to 0.010 inch. Respective orifices 54 and connecting ducts 56 are formed by inserting removable tabs (not shown) between the ends of the metal plates 46, filling the interior with a material 58 such as low melting point metal and then removing the tabs. Preferably we form the orifices 54 with lateral dimensions of from 0.03 to 0.04 inch and with vertical dimensions of from 0.005 to 0.010 inch. The uncapped end of the tube 48 is connected to the solenoid valve 38. We orient the manifold 36 so that air exiting from the orifices impines on the photoconductive surface 16 along a line of impingement which is transverse to the direction of movement and with the nozzle openings closely adjacent to the surface of drum 12.

To conserve the supply of high pressure air, we render the manifold 36 normally inoperative but supply it with a pulse of air to coincide with the arrival of the leading edge of the sheet 26. To this end we control the solenoid valve 38, which is normally closed, by means of a delay circuit such as the circuit 60 shown in FIG. 6 coupled to the photocell P located along the path B. In this circuit we couple lines 30 and 32 running from the photocell P to the input of a logical inverter 62 and to ground respectively, the polarities being such that inverter 62 provides a logic "0" when photocell P is energized. The output of inverter 62 is coupled to one terminal of a variable resistor R1 and one input of a two-input NAND gate 64 which provides a "0" logic output if, and only if, both inputs are at logic "1". The other terminal of resistor R1 is coupled to the second input of NAND gate 64 and to ground through a capacitor C1. NAND gate 64 has its output coupled to the input of a second inverter 66, which in turn drives one input of a two-input NAND gate 68, and to one terminal of a variable resistor R2, the other terminal of which is connected to the second input of NAND gate 68 and to ground through a capacitor C2. An inverter 70 responsive to NAND gate 68 has its output coupled to line 40 running to the solenoid valve 38. The other line 42 is coupled to ground.

So long as the path B remains clear, photocell P is energized by the light source 34 to cause inverter 62 to provide a logic 0. As a result, NAND gates 64 and 68 will supply logic 1's while inverters 66 and 70 will supply logic 0's, preventing the solenoid valve from being energized. When the leading edge of a sheet of paper 26 moves toward the photoconductive surface and blocks the optical path between the light source 34 and the photocell P, photocell P will become quiescent, causing inverter 62 to produce a logic 1. This logic 1 is immediately applied to the directly-connected input terminal of NAND gate 64, but is applied to the other input terminal only after capacitor C1 becomes sufficiently charged through resistor R1. As a result, the output of NAND gate 64 undergoes a 1 to 0 level change after a delay period which may be adjusted by adjusting the value of R1. This delayed triggering pulse is used to generate a relay energizing pulse having the desired duration. Immediately before this level change the inputs to NAND gate 68 coupled through inverter 66 and resistor R2 are at logic levels 0 and 1 respectively. When NAND gate 64 changes from 1 to 0, the inverter-coupled input changes to 1 and the output of NAND gate 68 immediately changes to 0 so that inverter 70 applies a pulse to the winding 38. The duration of the pulse is determined by the time constant of the circuit including R2 and C2, which circuit delays the application of the output of NAND circuit 64 to the second input to NAND circuit 68. It will readily be appreciated that the pulse duration can be changed by varying R2. When the photocell P is again uncovered the circuit returns to its quiescent state.

In the form of our system illustrated in FIG. 1 we provide a high volume relatively low pressure manifold 72 for directing air against the underside of the sheet after the leading edge has been stripped from the drum by manifold 36. We connect manifold 72 to a suitable high volume source such as a fan 73. We form manifold 72 with a relatively wide slit 74 extending across the width of the manifold and so located as to direct air into the space between the drum and the separated portion of the sheet 26, bending it back towards a conveyor belt 76 supported to one end by a pulley 78. The backward bending of the sheet 26 is assisted by a guide 80 which extends laterally in spaced relation to the drum surface 16 and is perforated or otherwise formed to permit the free flow of air from the low pressure manifold 72.

Figure 2:
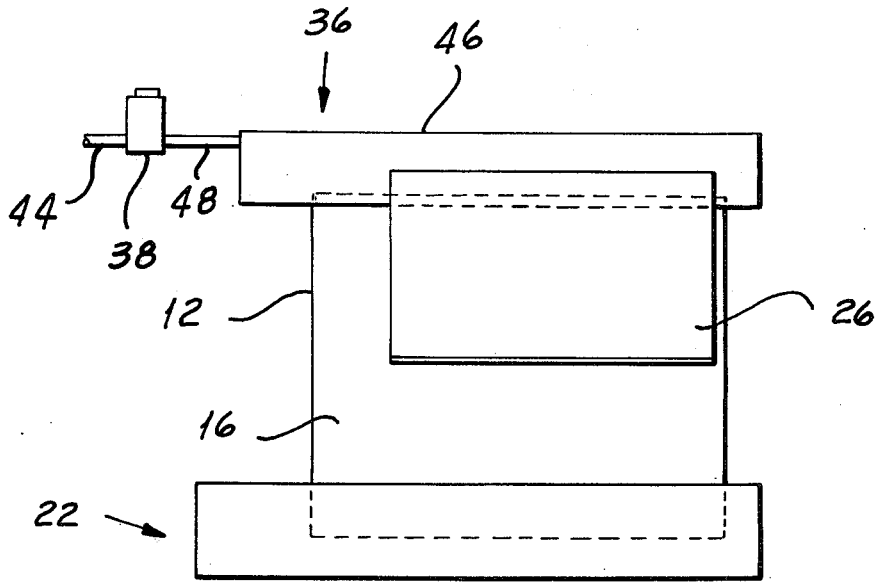
FIG. 2 is a front elevation of the machine shown in FIG. 1 with some parts omitted.

Referring now to FIG. 7, we show an alternative high velocity air jet manifold 81 which may be used in the machine shown in FIGS. 1 and 2. This form of our high velocity manifold progressively separates the sheet of paper 26 from one lateral edge to the other. Like manifold 36, manifold 81 extends across the drum surface in spaced relationship thereto at a location following that of the corona charger 28. We form manifold 81 in a manner similar to that used to form manifold 36 by wrapping a metal plate 82 having an edge extension 83 around a metal tube 84 having a cap 85 at one end to seal that end, a plurality of spaced perforations 86 along a portion of its length, and a perforation 87 near its capped end. By using tabs in a manner similar to that used to form orifices 54 and ducts 56, we form respective orifices 88 and connecting ducts 89. In addition, we form an edge orifice 90 on the inner edge of the edge extension 83 which is connected to the tube perforation 87 by a duct 91. Orifice 90 is oriented to provide an air jet which is directed under the lateral paper edge, preferably at about a 30° angle with respect to the transverse and against the movement of the photoconductor 16. In addition to providing edge orifice 90, we cant the manifold 81 forwardly in the direction of drum travel from the right end of the manifold to the left end thereof as viewed in FIG. 7.

In operation, the manifold 81 provides air jets which impinge edges of the paper 26 at staggered instants of time, beginning with the edge orifice 90 and progressing over the the other side of the manifold 81. As a result, the paper 26 is peeled from the corner adjacent the edge orifice 90, rather than in the laterally symmetric fashion characteristic of the manifold 36 shown in FIGS. 3 through 5.

Referring now to FIGS. 8 and 9, we show another alternative high velocity air jet manifold 92 which progressively separates the sheet of paper 26 from one lateral edge to the other and which may be used in the machine shown in FIGS. 1 and 2. Manifold 92 includes an elongated support 97 formed with a longitudinal bore which slidably receives a tube 93, one end of which is closed by a cap 94 and the other end of which is adapted to be connected directly to a source of high pressure air. We form one of the longitudinal sides of support 97 with a plurality of generally laterally extending spaced grooves 100 and with a groove 102 inclined downwardly from right to left adjacent to the right end of the support as viewed in FIG. 8. All of the grooves 100 and 102 communicate with the longitudinal bore of the support 97. We assemble a cover plate 98 over the support side in which the grooves 100 and 102 are formed to provide passages leading from the longitudinal bore of the support to respective air jet outlets 99 and 101. We form the wall of tube 93 with perforations 95 spaced correspondingly to channels 100 and with a perforation 96 corresponding to the upper end of channel 102. Preferably the orifices 99 and 101 have vertical and lateral dimensions of approximately 0.005 inch and 0.04 inch respectively.

In operation, manifold 92, like manifold 81, provides a side air jet to the lateral edge of the sheet of paper 26 to separate the corner. If desired, the corner-lifting action of the manifold 92 may be augmented by canting the manifold 92 in the same manner as the manifold 81 shown in FIG. 7.

Because the tube 93 is movable with respect to the manifold 92 in this embodiment, it is possible to control the flow of air through the orifices 99 and 102 either by transversely shifting or by rotating the tube 93 with respect to the support 97 to move the perforations 95 and 96 out of alignment with respect to ducts 100 and 102. Referring now to FIG. 10, we show, by way of example, a tension spring 103 for normally biasing an end of the tube 93 against a stop 104 provided on a supporting surface 105 to hold the tube in a position at which its holes do not register with the grooves in support 97. The ends of spring 103 are, respectively, connected to the supporting surface and to an actuating arm 106 carried by the tube 93. To move the tube 93 into its aligned position, we actuate a solenoid 107 having lines 108 and 109 which are coupled to the delay circuit 60 shown in FIG. 6 in the same manner as lines 40 and 42 of the solenoid valve 38. A side air inlet 110 coupled to a flexible air line 111 allows the end of the tube 93 to be used in this fashion. Owing to the fact that this arrangement provides a control point which is closer to the orifices, the delay between the time air is admitted through the control point and the time it exits from the orifices 99 and 101 is shortened and timing reliability is thus improved.

Figure 11:
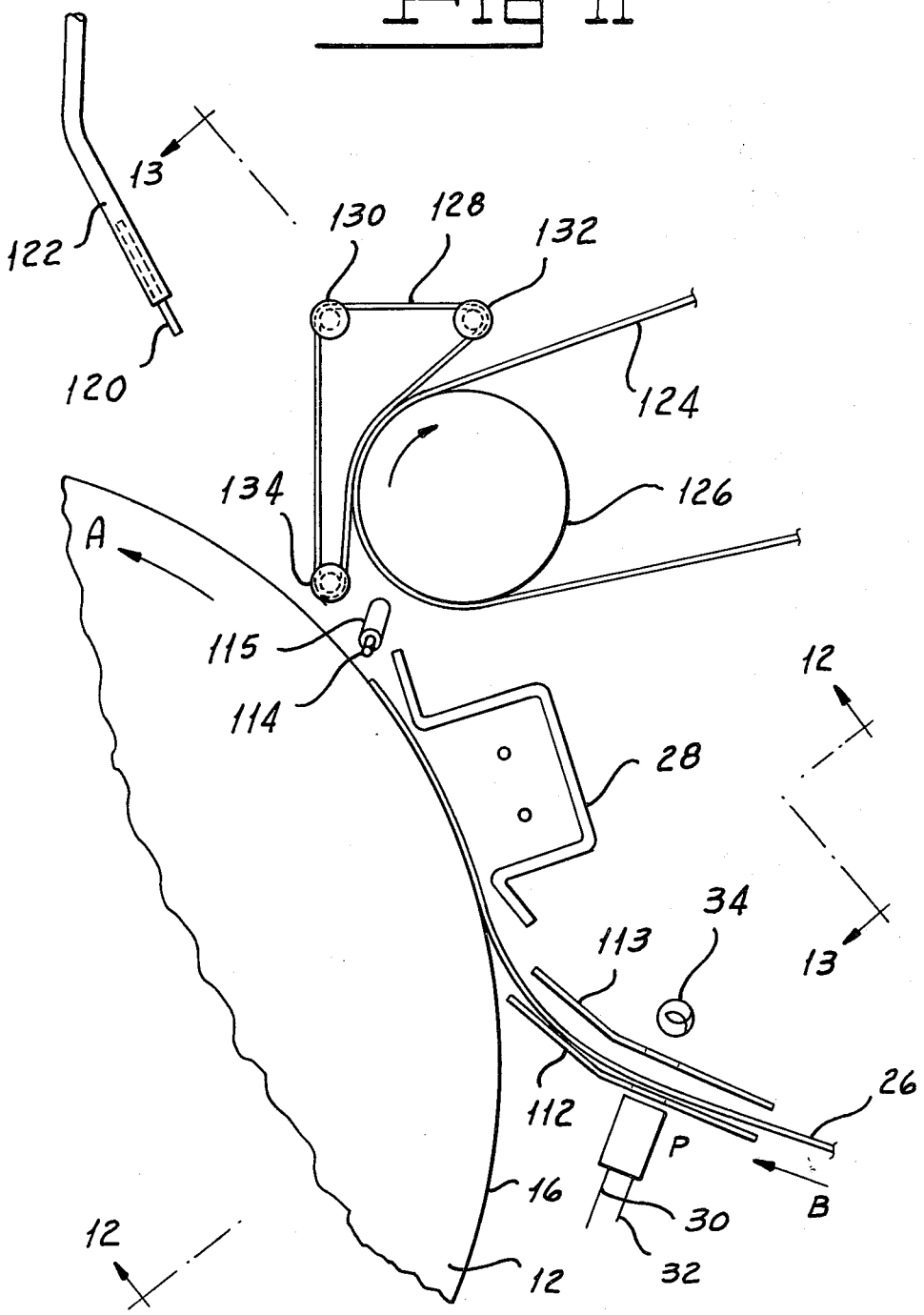
FIG. 11 is a fragmentary side elevation of an alternative embodiment of our pneumatic pick-off means employing only two air jets.
Figure 12:
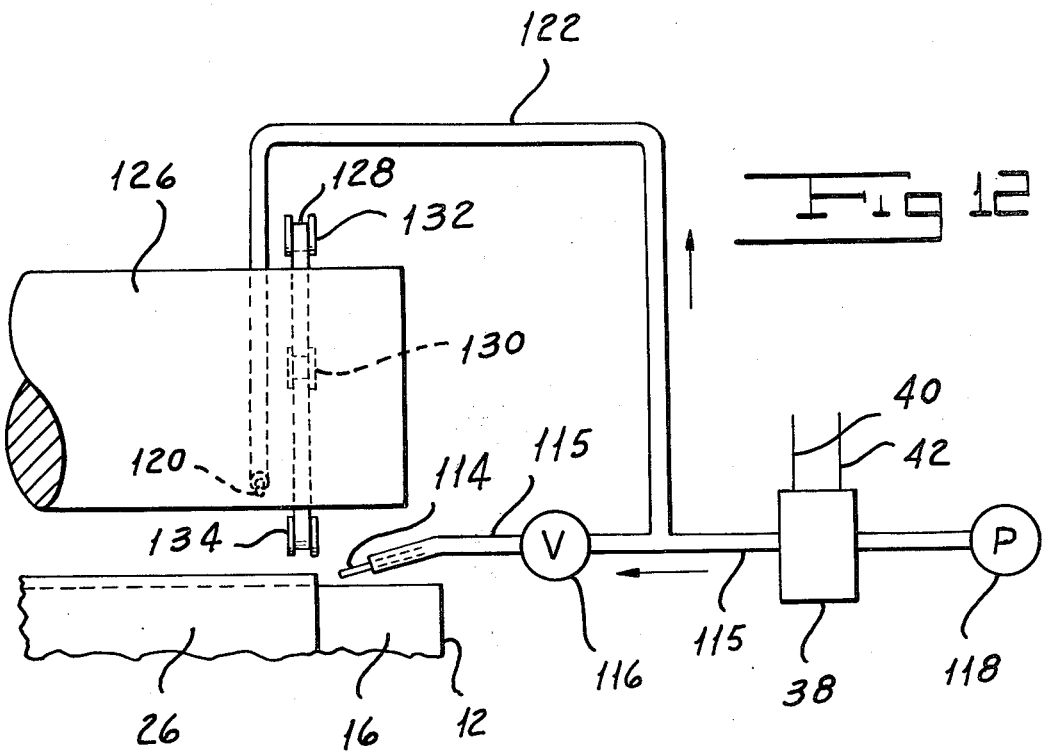
FIG. 12 is a fragmentary elevation of the embodiment shown in FIG. 11 taken along line 12—12 of FIG. 11.
Figure 13:
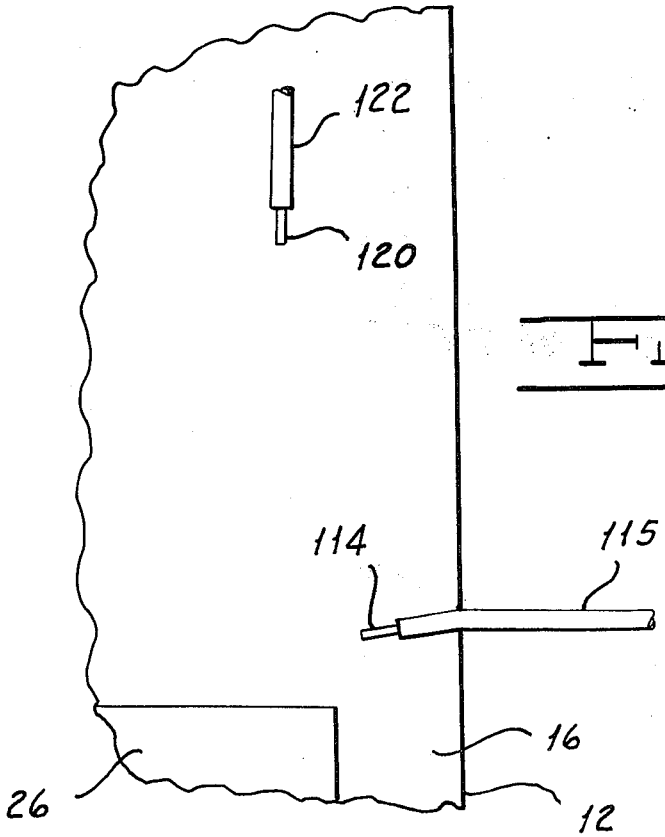
FIG. 13 is a fragmentary elevation of the embodiment shown in FIG. 11 taken along line 13—13 of FIG. 11.

Referring now to FIGS. 11 to 13, we show an embodiment of our invention employing a single leading edge air jet and a single side air jet to separate the paper from the photoconductive surface. In this embodiment, the sheet of paper 26 is advanced towards the photoconductive surface 16 between a pair of guide members 112 and 113, the advance being sensed by the photocell P as before.

A primary or side air jet nozzle 114, located adjacent the drum surface 16 following the corona charger 28, is arranged to direct a jet of air supplied by an air line 115 under a lateral edge of the sheet of paper 26 as the paper moves past the nozzle 114. Preferably the nozzle 114 has an orifice diameter of from 0.025 to 0.030 inch, is spaced about one-eighth inch from the paper edge, and is oriented down towards the drum surface 16 at an angle of from 10° to 15° to a transverse line at the point of impingement and back towards the corona charger 28 at an angle of from 5° to 10°. Air line 115 is connected through an adjusting valve 116 and a solenoid valve 38 to an air pump 118 preferably operating at a pressure of from 25 to 40 psi and having a flow capacity of at least 1 cfm. Lines 40 and 42 of the solenoid valve 38 are coupled to the delay circuit 60 shown in FIG. 6.

A secondary or leading edge air jet nozzle 120, located adjacent the drum surface 16 following the side air jet nozzle 114, is arranged to direct a jet of air supplied by an air line 122 under the leading edge of the sheet of paper as the leading edge moves past the primary nozzle 114. Preferably the nozzle 120, which is identical in construction to the nozzle 114, is spaced from two to two and one-half inches from the line of impingement and is oriented down towards the drum surface at an angle of from 12° to 15° to a tangent at the point of impingement. Air line 122 is coupled to air line 115 at a point between the adjusting valve 116 and the solenoid valve 38.

The delay circuit 60 is adjusted so that solenoid valve 38 is opened for 50 to 100 milliseconds to provide nozzles 114 and 120 with air when the leading edge of the paper 26 moves past the primary nozzle 114. Owing to the close spacing between the nozzle 114 and the lateral paper edge, air from the primary nozzle impinges on the drum at a velocity approaching its exit velocity, separating the corner of the paper 26 from the photoconductive surface 16. Once separated, the corner of the sheet of paper 26 is lifted up from the surface by the jet of air issuing from the more distant secondary nozzle 120 which impinges the paper at a lower velocity and over a broader area than the air from the primary nozzle 114.

After the corner of the sheet of paper 26 is lifted from the drum surface 16, it is fed through a transport assembly comprising a conveyor belt 124 extending across the width of the drum 12 and supported at one end by a pulley 126, and an edge ribbon 128 carried by pulleys 130, 132, and 134. The edge ribbon 128 is arranged to cooperate with the conveyor belt 124 and pulley 126 over an arcuate segment near the primary nozzle 114 to guide the separated corner portion of the paper 26 between the ribbon 128 and the belt 124.

Referring now to FIGS. 14 and 15, we show an embodiment of our pneumatic pick-off means which is employed in a belt-type rather than a drum-type machine. More particularly, the machine incorporating this embodiment includes an endless belt 136, a portion of which is shown in FIG. 13, having a photoconductive surface 138. As in the drum-type machines described earlier, we feed a sheet of paper 26 to the photoconductive surface through guide members 140 and 142 for transfer to the paper 26 of a developed toner image, the transfer being assisted as before by the corona charger 28. Also as before, we place a photocell P adjacent the path followed by the sheet of paper 26 to the belt 136. Photocell P is coupled by lines 30 and 32 to the delay circuit 60 shown in FIG. 6.

A roller 144 having a diameter of approximately one inch is placed after the corona charger 28 on the other side of the belt 136 to introduce a bend in the path of the belt. The bend provides a pick-off point for separating the paper 26 from the belt surface 138, separation being assisted in part by the tendency of the sheet of paper 26 to follow a straight line as it moves past the roller 144. We further assist the separation by means of a high velocity air jet manifold 146 comprising a hollow tube 148 extending across the width of the belt in spaced relationship thereto and fitted with a pair of nozzles 150 for directing air jets onto the bent portion of the belt 136 near its respective edges. The tube 148 is sealed at one end by a cap 152 and is coupled at its other end to a pressurized air supply (not shown) through a solenoid valve 38, terminals 40 and 42 of which are coupled to the delay circuit 60 shown in FIG. 6. The delay circuit 60 is timed so that air jets from the nozzles 150 impinge the belt surface 138 as the leading edge of the paper 26 reaches the roller 144. In this embodiment of our invention the jets of air from nozzles 150 impinge on a portion of the belt 136 which is on roller 144. The direction of the jets makes an angle of approximately 20° to 30° with the length of the belt extending upwardly from roller 144.

In the embodiment shown in FIGS. 13 and 14, we use a vacuum chamber 154 extending across photoconductive belt 136 opposite the roller 144 to remove the separated sheet 26 from belt 136. The chamber 154 is coupled to a low vacuum source, such as a fan (not shown), by means of a duct 156 and is perforated with a plurality of longitudinal slits 158 on the side facing the roller 144 to provide a suction force to the adjacent portion of the sheet of paper as it moves past the roller 144. The separated paper portion moves along the perforated side of the vacuum chamber 154 and is guided by a guide member 160 onto a conveyor belt 162 supported at one end by a pulley 164.

The operation of all forms of our pneumatic pick-off means will be apparent from the descriptions hereinabove. In each embodiment a pulsed jet or jets of high velocity air is directed onto the photoconductive surface in timed relationship with the arrival of the leading edge of the sheet at a predetermined position to separate an edge portion of the sheet from the surface. Secondary means, which may be high volume, low velocity air from a manifold, a secondary jet spaced from the photoconductive surface or a low volume suction means completes removal of the separated sheet for delivery to an outlet conveyor.

It will be seen that we have accomplished the objects of our invention. We have provided a pneumatic pick-off system for removing sheets of material from the photoconductive surface of an electrostatic copier. Our system effectively strips a sheet from the surface against the section of residue liquid developer between the sheet and the drum and against the action of the remaining electrostatic transfer charge. It is relatively simple in construction and certain in operation.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown an described.

Having thus described our invention, what we claim is:

1. In a copier in which a developed image is transferred from a moving image-bearing surface to a copy sheet having a leading portion contacting said surface, apparatus for removing the copy sheet from the image-bearing surface at a pick-off station of the copier, comprising:

air jet means disposed outboard of said leading sheet portion for directing a relatively high velocity jet of air against the leading portion of a side edge of the copy sheet at a location in said station at which said sheet is in contact with said surface to separate a corner portion of said sheet from said surface, said air jet means comprising an air jet nozzle so oriented as to produce an air jet having an appreciable component in the direction transverse to the direction and movement of said surface and a component directed toward said surface, and means for supplying air to said nozzle as the leading edge of said copy sheet approaches said location.

2. Apparatus as in claim 1 in which said air jet means comprises means for directing a plurality of air jets against the said surface at said pick-off station.

3. Apparatus as in claim 2 in which said air jet means comprises an elongated manifold having an entrance port for admitting air and a plurality of exit orifices spaced along the length thereof and means mounting said manifold adjacent to said surface with the length thereof extending across said surface and oriented to provide jets opposite to the movement of the photoconductive surface and impinging on said surface at an acute angle thereto.

4. Apparatus as in claim 1 in which said high air jet means comprises means for directing a plurality of air jets onto said surface in a direction opposite to the direction movement of the photoconductive surface, said jets impinging on said surface at an acute angle along a line which is canted with respect to a line running transversely of said surface progressively to peel said sheet off said photoconductive surface from one lateral edge of the sheet to the other.

5. Apparatus as in claim 4 in which said air jet means comprises a manifold extending across the photoconductive surface in skewed spaced relationship thereto, said manifold having an entrance port for admitting air and a plurality of exit orifices spaced along the length of the manifold.

6. Apparatus as in claim 1 in which said air jet means comprises means for producing a high velocity jet of air in response to air under pressure supplied thereto, a source of air under pressure, a normally closed valve and means for opening said valve to feed air from said source to said jet forming means to provide said jet concomitantly with the arrival of the leading edge of said sheet at said transfer station.

7. Apparatus as in claim 1 in which said air jet means comprises an elongated body having a longitudinally extending bore therein and respective passages leading from said bore to outlet jet producing orifices, means mounting said body adjacent to said photoconductive surface with the length thereof extending across the surface and with said orifice adapted to direct jets of air against said surface, an elongated tube mounted for sliding movement within said body bore, a plurality of openings in the wall of said tube, said openings in said tube wall adapted to register with said body passages in one position of said tube relative to said body, means for supplying air under pressure to said tube, means normally biasing said tube out of said one position, and means for moving said tube into said one position concomitantly with the arrival of said sheet at said pick-off station.

8. Apparatus as in claim 1 in which said air jet means comprises means for directing a plurality of jets of air onto said surface along a line across said photoconductive surface at the leading edge of a sheet arriving at said pick-off station and for directing a jet of air onto said surface at the side edge of a leading portion of a sheet arriving at said pick-off station.

9. Apparatus as in claim 1 in which air jet nozzle is directed inwardly toward said surface at an angle of from about 10° to 15°.

10. Apparatus as in claim 9 in which said air jet nozzle is directed rearwardly with reference to a line transverse to said surface at an angle of about 5° to about 10°.

11. Apparatus as in claim 1 in which said air jet has a component in a direction opposite to the direction of movement of said surface.

12. Apparatus as in claim 1 in which said air jet means is actuatable from a normally inoperative condition to an operative condition, said apparatus including means for actuating said air jet means to its operative condition concomitantly with the arrival of the leading edge of said sheet at said pick-off station.

13. Apparatus as in claim 12 in which said actuating means maintain said air jet means in its operative condition for a predetermined period of time.

14. Apparatus as in claim 13 in which said predetermined period of time is between about 50 milliseconds and about 200 milliseconds.

15. Apparatus as in claim 12 including means for conveying said sheet of copy material from a remote location along a predetermined path onto said photoconductive surface, and in which said actuating means includes means for sensing the arrival of said sheet at a predetermined point along said path.

16. Apparatus as in claim 15 in which said sensing means senses the leading edge of said sheet and in which said actuating means comprises delay means responsive to said sensing means for actuating said air jet means to its operative condition a predetermined time after said sensing means senses said leading edge.

17. Apparatus as in claim 1, further comprising:

a conveyor assembly spaced from said image-bearing surface at said pick-off station; and auxiliary means spaced from said image-bearing surface from directing a relatively low velocity flow of air against the inner surface of said separated sheet portion to urge said sheet away from image-bearing surface toward said conveyor assembly.

18. Apparatus as in claim 17 in which said auxiliary means directs said flow of air over a relatively large area of said sheet surface.

19. Apparatus as in claim 17 in which said auxiliary means operates continuously.

20. Apparatus as in claim 17 in which said air jet nozzle is a first air jet nozzle, said auxiliary means comprising:

a second air jet nozzle arranged to direct a jet of air against a portion of the leading edge of the copy sheet adjacent to said side edge as said copy sheet moves past said predetermined point; and means for providing air to said second air jet nozzle as said copy sheet moves past said predetermined point to urge said separated corner portion away from said photoconductive surface toward said conveyor assembly.

21. Apparatus as in claim 20 in which said first air jet nozzle is arranged relatively near said copy sheet side edge at said predetermined point and in which said second air jet nozzle is arranged relatively remote from said copy sheet leading edge at said predetermined point.

22. Apparatus as in claim 20 in which said means for providing air provide simultaneous pulses of air to said first and second air jet nozzles.

23. Apparatus as in claim 20 in which said second air jet nozzle is arranged at an angle of from about 12° to about 15° with a tangent to said surface at said predetermined point.

24. In a copier in which a developed image is transferred from a moving image-bearing surface to a copy sheet, apparatus for removing the copy sheet from the image-bearing surface at a pick-off station of said copier, comprising:

air jet means spaced from said image-bearing surface for directing a relatively high velocity jet of air against a portion of the edge of the copy sheet as it moves past a predetermined point in said station to separate a corner portion of said sheet from said surface, said air jet means comprising a first air jet nozzle arranged to direct a jet of air against the leading portion of a side edge of the copy sheet as said copy sheet moves past a predetermined point in said station, said first air jet nozzle being directed inwardly at an angle of from about 10° to about 15° toward said surface and being directed rearwardly with respect to a line running transversely of said surface at an angle of from about 5° to 10°, and means for providing air to said first air jet nozzle as said copy sheet moves past a predetermined point;

a conveyor assembly spaced from said image-bearing surface at said pick-off station; and auxiliary means spaced from said image-bearing surface at said pick-off station; and auxiliary means spaced from said image-bearing surface for directing a relatively low velocity flow of air against the inner surface of said separated sheet portion to urge said sheet away from said image-bearing surface toward said conveyor assembly, said auxiliary means comprising a second air jet nozzle arranged to direct a jet of air against a portion of the leading edge of the copy sheet adjacent to said side edge of said copy sheet moves past said predetermined point, said second air jet nozzle being arranged at an angle of about 12° to about 15° with a tangent to said surface at said predetermined point, and means for providing air to said second air jet nozzle as said copy sheet moves past said predetermined point.

25. In an electrostatic copier in which a developed electrostatically formed image is transferred from a moving image-bearing surface to a copy sheet, apparatus for removing the copy sheet from the image-bearing surface, comprising:

a first air jet nozzle for directing a jet of air against the leading portion of a side edge of a copy sheet as said copy sheet moves past a predetermined point, said first air jet nozzle being spaced from the image-bearing surface and being directed generally transversely with respect to the movement of said copy sheet;

a second air jet nozzle for directing a jet of air against a portion of the leading edge of the copy sheet adjacent to said side edge as said copy sheet moves past said predetermined point, said second air jet nozzle being spaced from the image-bearing surface and being directed generally longitudinally with respect to the movement of said copy sheet; and means for simultaneously providing pulses of high pressure air to said first and second air jet nozzles as said copy sheet moves past said predetermined point to separate a corner of said copy sheet.

26. Apparatus as in claim 25 in which said first air jet nozzle is closely spaced from said image-bearing surface and said second air jet nozzle is relatively distantly spaced from said image-bearing surface.

27. Apparatus as in claim 25 in which said first air jet nozzle is directed slightly rearwardly with respect to the movement of said copy sheet.

28. Apparatus as in claim 25 in which said air providing means provides air at a pressure between 25 and 40 pounds per square inch.

29. Apparatus as in claim 25 in which said nozzles have orifice diameters of between 0.025 and 0.030 inch.

30. Apparatus as in claim 25 in which said nozzles are directed slightly toward said image-bearing surface.

31. Apparatus as in claim 25, further comprising means for directing a relatively low velocity stream of air against said separated corner portion to lift said portion from said imaging surface.

32. Apparatus as in claim 25 in which said first air jet nozzle is spaced about ⅛ inch from said side edge as said copy sheet moves past said predetermined point.

33. Apparatus as in claim 32 in which said second air jet nozzle is spaced between 2 and 2½ inch from said leading edge as said copy sheet moves past said predetermined point.

34. Apparatus as in claim 25 in which said second air jet nozzle is spaced between 2 and 2½ inches from said leading edge as said copy sheet moves past said predetermined point.

* * * * *